US008414711B2

(12) United States Patent
Uchida et al.

(10) Patent No.: US 8,414,711 B2
(45) Date of Patent: Apr. 9, 2013

(54) METHOD OF SURFACE TREATMENT FOR ALUMINUM OR ALUMINUM ALLOY

(75) Inventors: Hiroki Uchida, Hirakata (JP); Kazuki Yoshikawa, Hirakata (JP); Toshiaki Shibata, Hirakata (JP)

(73) Assignee: C. Uyemura & Co., Ltd., Osaka (JP)

( * ) Notice: Subject to any disclaimer, the term of this patent is extended or adjusted under 35 U.S.C. 154(b) by 559 days.

(21) Appl. No.: 12/544,304

(22) Filed: Aug. 20, 2009

(65) Prior Publication Data

US 2010/0044341 A1 Feb. 25, 2010

(30) Foreign Application Priority Data

Aug. 21, 2008 (JP) ..... 2008-212924

(51) Int. Cl.
*B05D 3/10* (2006.01)

(52) U.S. Cl. ..... 148/275; 148/273; 216/37; 216/77; 205/213

(58) Field of Classification Search ..... 148/273, 148/275; 216/37, 77; 205/213
See application file for complete search history.

(56) References Cited

U.S. PATENT DOCUMENTS

| | | | | |
|---|---|---|---|---|
| 5,182,006 | A * | 1/1993 | Haydu et al. | 205/213 |
| 6,028,011 | A | 2/2000 | Takase et al. | |
| 6,747,351 | B2 | 6/2004 | Yamaguchi et al. | |
| 2005/0123816 | A1 * | 6/2005 | Gao et al. | 429/30 |
| 2008/0169267 | A1 * | 7/2008 | Uchida et al. | 216/37 |

FOREIGN PATENT DOCUMENTS

| | | | |
|---|---|---|---|
| JP | 9-316650 | A | 12/1997 |
| JP | 10-265961 | A | 10/1998 |
| JP | 11-87392 | A | 3/1999 |
| JP | 11-214421 | A | 8/1999 |
| JP | 2002-190491 | A | 7/2002 |
| JP | 2004-263267 | * | 9/2004 |
| JP | 2004-263267 | A | 9/2004 |
| JP | 2004-346405 | A | 12/2004 |
| JP | 2005-314738 | A | 11/2005 |
| JP | 2007-254886 | A | 10/2007 |

OTHER PUBLICATIONS

"Evaluation of Adhesion; m-ELT method," technical data of Toshiba Nanoanalysis Corporation, Jul. 22, 2000.

"Kobelnics" vol. 13, pp. 6 to 8, Oct. 2004, published by Kobelco Research Institute, Inc.

* cited by examiner

*Primary Examiner* — Lois Zheng

(74) *Attorney, Agent, or Firm* — Birch, Stewart, Kolasch & Birch, LLP

(57) ABSTRACT

A workpiece including aluminum or an aluminum alloy on a surface thereof is subjected to surface treatment including the steps of immersing in an acidic or alkaline aluminum oxide film-removing solution containing a salt or oxide of a metal capable of substitution with aluminum and forming a substituted metal layer and contained in the removing solution on a surface of the aluminum or aluminum alloy while removing an aluminum oxide film on aluminum or aluminum alloy surface, forming a substituted zinc film by zinc substitution treatment without removing the substituted metal layer, removing the substituted metal layer and substituted zinc film with an oxidizing liquid, and subjecting again to zinc substitution treatment, forming a substituted zinc film.

13 Claims, No Drawings

METHOD OF SURFACE TREATMENT FOR ALUMINUM OR ALUMINUM ALLOY

BACKGROUND OF THE INVENTION

1. Field of the Invention

This invention relates to a surface treatment method for aluminum or aluminum alloys and more particularly, to a surface treatment method for aluminum or aluminum alloys, which is effective for pretreatment in case where UBM (under bump metal) or bumps are formed on a wafer by plating.

2. Prior Art

For the formation of an UBM or bump on a silicon wafer, the usual practice is to use a method wherein an aluminum thin film electrode in the form of a pattern is subjected to zinc substitution treatment to form a substituted zinc film on a wafer, followed by forming bumps by electroless nickel plating, a method wherein palladium treatment is performed in place of the above zinc substitution treatment, after which bumps are formed by electroless nickel plating, or a method wherein an aluminum thin film electrode is substituted on the surface thereof directly with nickel and bumps are formed by self-catalytic electroless nickel plating.

In the formation of UBM or bumps by use of any of such methods as mentioned above, it is usual to perform, as a pre-treatment stage, a defatting treatment against the aluminum thin film electrode, a treatment of removing an aluminum oxide film or metal impurities from the aluminum thin film electrode, and the like. In this case, with an aluminum oxide film, taken out among similar aluminum oxide films, whose thickness is very thin as will be caused by nitric acid immersion, plating treatment is possible without inviting any problem if the plating treatment is performed as it is in a subsequent step. Nevertheless, where such a firm aluminum oxide film as is formed in manufacturing steps including a machining or cutting step and an annealing step is left on the surface, adhesion of a plated layer formed in a subsequent step may become inadequate or holes may be formed in the plated layer in some cases, or no plated layer may be deposited in the worst case. Accordingly, such a firm aluminum oxide film has to be completely removed beforehand.

In order to cope with the problems set out above, there has been proposed a method (see JP-A 11-87392) wherein a plated underlying layer is formed by a dry process without dissolution of an aluminum oxide film. However, this method still has rooms for improvements in view of the facts that the procedure of the method is complicated, the method is disadvantageous in promptness and production costs, and because the residual oxide film is insulating in nature, a thermal resistance increases with the result that electric characteristics become worsened.

It will be noted that mention is made, as prior art references, of JP-A 2004-346405 and JP-A 2007-254866, aside from the above-mentioned Laid-open Patent Application.

SUMMARY OF THE INVENTION

The present invention has been made under these circumstances in the art. It is accordingly an object of the invention to provide a method of surface treatment for aluminum or aluminum alloy wherein a firm oxide film can be removed readily, promptly and reliably without excess etching of an aluminum or aluminum alloy surface.

The inventors have made intensive studies in order to achieve the above object and, as a result, found that such a surface treatment method is effective as comprising immersing an aluminum or aluminum alloy surface, on which an aluminum oxide film has been formed, in an acidic or alkaline, aluminum oxide film-removing solution containing a salt or oxide of a metal capable of substitution with aluminum, subjecting the aluminum or aluminum alloy surface, on which a substituted metal layer of the metal capable of substitution with aluminum present in the removing solution has been formed while removing the aluminum oxide film, to zinc substitution treatment (zincate treatment) without immediate removal of the substituted metal layer, thereby forming a substituted zinc layer, removing the substituted metal layer along with the substituted zinc layer by means of a liquid having an oxidizing behavior, and re-forming a substituted zinc film on the surface. More particularly, according to this method, while suppressing corrosion in the surface of aluminum or an aluminum alloy to an extent as small as possible, the oxide film can be removed quickly at low temperatures. Moreover, it has been found that when the aluminum or aluminum alloy on which the substituted zinc film has been formed by the method is formed with a plated layer thereon, good adhesion between the aluminum or aluminum alloy surface and the plated layer is obtained. The invention is based on these findings.

More particularly, according to the invention, there is provided a method of surface treatment for aluminum or aluminum alloy, which includes the steps of:

(A) immersing a workpiece to be treated, which includes aluminum or an aluminum alloy on at least a surface thereof, in an acidic or alkaline aluminum oxide film-removing solution containing a salt or oxide of a metal capable of substitution with aluminum, and forming a substituted metal layer of the metal, which is capable of substitution with aluminum and is contained in the removing solution, on a surface of the aluminum or aluminum alloy while removing an aluminum oxide film on the aluminum or aluminum alloy surface;

(B) forming a substituted zinc film by zinc substitution treatment without removal of the substituted metal layer;

(C) removing the substituted metal layer along with the substituted zinc film by means of a liquid having an oxidizing behavior; and (D) subjecting the resulting surface to zinc substitution treatment again to form a substituted zinc film thereon.

It is preferred to form a plated layer on the substituted zinc film after the step (D).

After the step (D), the method may further include the steps of:

(E) removing the substituted zinc film by means of a liquid having an oxidizing behavior; and (F) further subjecting the resulting surface to zinc substitution treatment to form a substituted zinc film thereon.

The steps (E) and (F) may be carried out only once in this order, or may be alternately repeated twice or more.

In this case, after the step (F), a plated layer may be formed on the substituted zinc film.

According to the surface treatment method of the invention, while suppressing the surface of aluminum or an aluminum alloy from being corroded as much as possible, the metal film derived from the salt or oxide of the metal contained in the removing solution can be formed. Furthermore, this metal film is very unlikely to eat away the surface of aluminum or an aluminum alloy and can be readily dissolved out and removed at low temperatures. Hence, even if the thickness of aluminum or an aluminum alloy is very thin, the surface of the aluminum or aluminum alloy can be activated while reliably leaving the aluminum or aluminum alloy. Moreover, when a plated layer is formed on the aluminum or aluminum alloy on which the substituted zinc film has been formed by the treatment of the method, good adhesion between the aluminum or aluminum alloy surface and the plated layer is ensured. The surface treatment method of the invention can be conveniently employed for the activation treatment of an aluminum thin film electrode surface formed, especially, on a silicon wafer.

DETAILED DESCRIPTION OF THE PREFERRED EMBODIMENTS

The surface treatment method for aluminum or an aluminum alloy according to the invention includes the steps of:

(A) immersing a workpiece to be treated, which includes aluminum or an aluminum alloy on at least a surface thereof, in an acidic or alkaline, aluminum oxide film-removing solution containing a salt or oxide of a metal capable of substitution with aluminum, and forming a substituted metal layer of the metal, which is capable of substitution with aluminum and is contained in the removing solution, on a surface of the aluminum or aluminum alloy while removing an aluminum oxide film on the aluminum or aluminum alloy surface;

(B) forming a substituted zinc film by zinc substitution treatment without removal of the substituted metal layer;

(C) removing the substituted metal layer along with the substituted zinc film by means of a liquid having an oxidizing behavior; and (D) subjecting the resulting surface to zinc substitution treatment again to form a substituted zinc film thereon.

In the step (A), the workpiece to be treated, which has aluminum or an aluminum alloy on at least a surface thereof, is immersed in an acidic or alkaline solution of removing an aluminum oxide film, under which while removing an aluminum oxide film from the aluminum or aluminum alloy surface, a metal film (substituted metal layer) derived from the metal salt or oxide contained in the removing solution is formed on the aluminum or aluminum alloy surface of the workpiece.

The aluminum oxide film-removing solution used may be one that is set out, for example, in JP-A 2004-263267. More particularly, there can be used an aluminum oxide film-removing solution (first oxide film-removing solution) containing a salt of a metal capable of substitution with aluminum and an acid.

The metal of the metal salt contained in the first oxide film-removing solution (acidic removing solution) is not critical in type so far as it is able to be substituted with aluminum. Preferably, such a metal is one that is smaller in ionization tendency than aluminum and includes, for example, zinc, iron, cobalt, nickel, tin, lead, copper, mercury, silver, platinum, gold, palladium or the like. The metal salts include water-soluble salts of the metal such as a nitrate, sulfate and the like. Especially, sulfates are preferred because of the stability of the resulting removing solution and the less attack against aluminum or aluminum alloy materials. These salts may be used singly or in combination of two or more.

Of these, silver, nickel and copper are preferably used because of the less concern that they precipitate at other sites. Especially, copper and silver are more preferred in view of the fact that they are much smaller in ionization tendency than aluminum, so that the substitution reaction is more likely to proceed and thus, an etching time can be shortened.

Although the concentration of a metal salt used in the first oxide film-removing solution is not critical, the amount of a metal is usually not less than 1 ppm (mg/liter), preferably not less than 10 ppm (mg/liter) and its upper limit is not larger than 10,000 ppm (mg/liter), preferably not larger than 5,000 ppm (mg/liter). A lower concentration may lead to the possibility that aluminum is not substituted with the metal, or supplement of the metal salt becomes necessary. On the other hand, a higher concentration may lead to the possibility that in case where aluminum or an aluminum alloy is provided as an electrode patterned on a wafer, members other than the aluminum or aluminum alloy pattern is attacked, or the metal is precipitated as running over members other than the aluminum or aluminum alloy material.

The acid used in the first oxide film-removing solution is not critical in type. The acid should be capable of dissolving the oxide film and mention is made, for example, of sulfuric acid, phosphoric acid, hydrochloric acid, hydrofluoric acid and the like. These may be used singly or in admixture of two or more. Of these, sulfuric acid is preferred from the standpoints of the stability of the resulting removing solution and the less attack against aluminum or aluminum alloy materials.

Although no specific limitation is placed on the concentration of the acid in the removing solution, the concentration is generally not less than 10 g/liter, preferably not less than 15 g/liter and the upper limit is generally not larger than 500 g/liter, preferably not larger than 300 g/liter. This allows the pH to be set at one or below. A lower concentration of the acid may lead to the possibility that the oxide film is not dissolved and no effect is expected. On the other hand, a higher concentration may lead to the possibility that members other than the aluminum or aluminum alloy material may be attacked.

As the aluminum oxide film-removing solution, there may be used another type of aluminum oxide film-removing solution (second oxide film-removing solution), which contains a salt or oxide of a metal capable of substitution with aluminum, a solubilizer for ions of the metal, and an alkali and whose pH ranges from 10 to 13.5.

The metal of the metal salt or metal oxide contained in the second oxide film-removing solution (alkaline removing solution) is not critical so far as it is able to be substituted with aluminum. It is preferred to use a metal whose ionization tendency is smaller than that of aluminum. Mention is made, for example, of manganese, zinc, iron, cobalt, nickel, tin, lead, copper, mercury, silver, platinum, gold, palladium and the like, and the metal salts include water-soluble salts of the metals such as a nitrate, a sulfate and the like. Of these, manganese and zinc are preferred because of the small difference in reduction potential from aluminum.

Although the concentration of the metal salt or metal oxide used in the second oxide film-removing solution is not critical, the amount of the metal is generally not less than 1 ppm (mg/liter), preferably not less than 10 ppm (mg/liter) and the upper limit is generally not large than 10,000 ppm (mg/liter), preferably not larger than 5,000 ppm (mg/liter). A lower concentration of the metal salt or metal oxide may lead to the possibility that the metal is not satisfactorily substituted with the aluminum material, or supplement of a metal salt or metal oxide becomes necessary. On the other hand, a higher concentration may lead to the possibility that in case where aluminum or an aluminum alloy is provided as an electrode patterned on a wafer, members other than the aluminum or aluminum alloy pattern may be attacked or the metal is precipitated as running over members other than the aluminum or aluminum alloy material.

The solubilizer for the metal ions contained the second oxide film-removing solution is not critical in type, for which there may be used ordinary complexing agents and chelating agents. Specific examples include hydroxycarboxylic acids, and their salts, such as glycolic acid, lactic acid, malic acid, tartaric acid, citric acid, gluconic acid, heptogluconic acid and the like, aminocarboxylic acids, and their salts, such as glycine, aminodicarboxylic acid, nitrilotriacetic acid, EDTA, hydroxyethylenediaminetriacetic acid, diethylenetriaminepentaacetic acid, polyaminopolycarboxylic acid and the like, phosphorous acid or phosphonic acid-based chelating agents such as HEDP, amino-trimethyl phosphonic acid, ethylenediamine tetra(methyl phosphonic acid) and the like and salts thereof, and amine chelating agents such as ethylenediamine, diethylenetriamine, triethylenetetramine and the like.

Although the concentration of the solubilizer used in the second oxide film-removing solution is not critical, the total concentration of the solubilizers relative to the metal salt used is at a molar ratio of from 0.5 to 10, preferably form 0.8 to 5.

The alkali contained in the second oxide film-removing solution is not critical in type and should be an alkali (base) capable of dissolving the oxide film. The alkali includes, for example, an alkali metal hydroxide such as LiOH, NaOH, KOH or the like, and a quaternary ammonium compound such as tetramethylammonium hydroxide (TMAH), choline or the like. It will be noted that the amount of an alkali is sufficient to adjust the pH of the removing solution within a defined range of 10 to 13.5, preferably 11 to 13. If the pH is smaller than 10, dissolution rare lowers considerably. On the other hand, when the pH exceeds 13.5, dissolution rare becomes so high as not to control the rate.

It is preferred from the standpoint of imparting moisture wettability that polyethylene glycol and/or a surface active agent is contained in the first and second oxide film-removing solutions, respectively. Although the type of surface active agent used is not critical, mention is made, for example, of nonionic surface active agents such as a polyethylene glycol surface active agent, a polyoxyethylene/oxypropylene block copolymer surface active agent and the like, and other types of anionic and cationic surface active agents Of these, nonionic and anionic surface active agents are preferred in view of uniform treatability. These may be used singly or in combination of two or more.

Where polyethylene glycol is used, for example, the molecular weight thereof is not critical and is generally in the range of not less than 100, preferably not less than 200. The upper limit is generally not larger than 20,000, preferably not larger than 6,000. A larger molecular weight may lead to the possibility that solubility becomes worsened. On the other hand, a smaller molecular weight may not contribute to imparting moisture wettability. It will be noted that polyethylene glycol used may be a commercially sold one.

Although no specific limitation is placed on the concentration of polyethylene glycol and/or a surface active agent in the removing solution, the concentration is generally not less than 1 ppm (mg/liter), preferably not less than 10 ppm (mg/liter) and the upper limit is generally not larger than 5,000 ppm (mg/liter), preferably not less than 2,000 ppm (mg/liter). A smaller concentration may lead to the possibility that the effect of moisture wettability becomes low. On the other hand, a higher concentration may lead to the possibility that a substituted metal deposits on members other than aluminum, or an aluminum, alloy.

It will be noted that the first and second oxide film-removing solutions should preferably be each in the form of an aqueous solution from the standpoint of operation safety. Besides, methanol, ethanol, IPA and the like, and their mixed solvents with water may also be usable. These solvents may be used singly or in combination of two or more.

The immersion conditions of immersing a workpiece including aluminum or an aluminum alloy thereon in the aluminum oxide-removing solutions are not critical and can be appropriately set depending on the thickness of an aluminum oxide film to be removed. The immersion time is generally not shorter than 10 seconds, preferably not shorter than 20 seconds, more preferably not shorter than 1 minute and most preferably not shorter than 2 minutes. The upper limit is generally not longer than 20 minutes, preferably not longer than 15 minutes. A shorter immersion time may lead to the possibility that little substitution proceeds, resulting in inadequate removal of the oxide film. On the other hand, a longer time may lead to the possibility that the removing solution infiltrates from small holes in a substituted metal layer, with concern that aluminum or an aluminum alloy is dissolved out.

The immersion temperature is not critical as well and is generally not lower than 30° C., preferably not lower than 35° C. and more preferably not lower than 60° C. and the upper limit is generally not higher than 100° C., preferably not higher than 95° C. and more preferably not higher than 70° C. Particularly, with the first oxide film-removing solution (acidic removing solution), the temperature preferably ranges from 60 to 95° C. Likewise, with the second oxide film-removing solution (alkaline removing solution), the temperature is preferably from 35 to 70° C. A lower temperature may lead to the possibility that the oxide film cannot be dissolved. On the other hand, a higher immersion temperature may lead to the possibility that members other than an aluminum or aluminum alloy material are attacked. It is preferred from the standpoint of uniform treatment that the solution is stirred and a workpiece to be treated is swung upon immersion.

A workpiece to be treated according to the invention, which includes aluminum or an aluminum alloy on the surface thereof, may be one that is formed entirely of aluminum or an aluminum alloy, or may be one wherein a non-aluminum material (e.g. silicon or FR4 (a substrate material for printed boards)) is covered wholly or partly with aluminum or an aluminum alloy. The form of aluminum or an aluminum alloy is not critical and the method of the invention may be appropriately applied, for example, to a blank material, a rolled material, a cast material, a film and the like. It will be noted that when a film of aluminum or an aluminum alloy is formed on the surface of a non-aluminum material, the manner of forming the film is not critical. The film formation can be conveniently carried out, for example, by a vacuum deposition method, a sputtering method, a vapor plating method such as an ion plating method or the like.

The film thickness is generally not less than 0.5 μm, preferably not less than 1 μm in view of the fact that an aluminum or aluminum alloy base can be reliably left when the surface treatment method of the invention is used. It should be noted that the upper limit of thickness is not critical and is usually not larger than 100 μm. Especially, the second oxide film-removing solution hardly corrodes aluminum or an aluminum alloy and can thus be effectively employed for such a thin base film, especially a film having a thickness of not larger than 1.0 μm, as would be difficult in application of existing treating solutions in view of the problem in that the film becomes too thin after the treatment.

Further, the component of the film is not critical so far as it is made of aluminum or an aluminum alloy. The surface treatment method of the invention can be conveniently applied to a film such as, for example, Al—Si (wherein the Si content ranges from 0.5 to 1.0 wt %), Al—Cu (wherein the Cu content ranges from 0.5 to 1.0 wt %) or the like.

The step (B) is one wherein a substituted zinc film is formed by zinc substitution treatment without removal of the substituted metal layer formed in the step (A).

After the immersion of such a workpiece as set out hereinabove in the oxide film-removing solution, the metal film formed on the workpiece surface (i.e. the substituted metal layer derived from the salt or oxide of a metal capable of substitution with aluminum contained in the removing solution of the invention) is ordinarily removed prior to formation of a plated layer in case where such a plated layer is formed on the aluminum or aluminum alloy surface. In the practice of the invention, the zinc substitution treatment is carried out without immediate removal of the substituted metal layer from the standpoint of improving adhesion with the plated layer, thereby forming a zinc film on the substituted metal layer, or on the aluminum or aluminum alloy layer where no substituted metal layer is formed, or preferably on both. Thereafter, the substituted metal layer is removed along with the substituted zinc film in the subsequent step (C).

For the zinc substitution treatment (zincate treatment), either an acidic zinc substitution treatment or an alkaline zinc substitution treatment may be used, of which the alkaline zinc substitution treatment is preferred. The zinc substitution treatment is intended to mean a treatment wherein a solution containing a zinc salt is used and zinc is precipitated by substitution. With an alkaline zinc substitution treatment, there is used an alkaline zincate solution. For the acidic zinc substitution treatment, a solution containing an acidic zincate is used thereby subjecting zinc to substitution precipitation. These treatments can be carried out by known techniques using, for example, a commercially available alkaline zinc substitution solution such as MCT-17, made by C. Uemura & Co., Ltd., and a commercially available acidic zinc substitution solution such as MCS-30, made by C. Uemura & Co., Ltd. The treating conditions are not critical. For example, the treatment may be carried out at a temperature of 10 to 40° C. for a time of 5 to 300 seconds. During the course of the zinc substitution, the workpiece to be plated may be stood still or swung, and liquid agitation may be effected.

The step (C) is one wherein the substituted metal layer formed in the step (A) is removed along with the substituted zinc film formed in the step (B) by means of a liquid having an oxidizing behavior. As stated hereinabove, the substituted metal layer formed in the step (A) is removed after the formation of the substituted zinc film.

In the course of the dissolution of the substituted metal layer and the substituted zinc film, there is used a liquid having an oxidizing behavior from the standpoint of mitigating reactivity with the underlying aluminum or aluminum alloy. The liquid having an oxidizing behavior may be acidic or alkaline. Preferred acidic liquids having an oxidizing behavior include acids having an oxidizing behavior such as nitric acid or aqueous solutions thereof, and acids having no oxidizing behavior or aqueous solutions thereof to which there are added one or more of oxidizing agents including, for example, hydrogen peroxide, sodium persulfate, ammonium persulfate, potassium persulfate and the like. In this case, the acid has the function of dissolving the substituted metal layer and substituted zinc film and the oxidizing agent has the function of mitigating reactivity with aluminum or an aluminum alloy. It will be noted that among the oxidizing agents, hydrogen peroxide is preferred from the standpoint that it consists of hydrogen and oxygen and is reduced into water. From the standpoints of stability and ease in handling, sodium persulfate and potassium persulfate are preferred.

Where nitric acid is used as an acid (and an oxidizing agent), the amount of nitric acid in a dissolution solution (in the form of an aqueous solution) is generally not smaller than 200 ml/liter, preferably not smaller than 300 ml/liter and the upper limit is generally not larger than 1,000 ml/liter, preferably not larger than 700 ml/liter. A smaller amount may lead to the possibility that the oxidizing force is so low that the reaction does not stop. It will be noted that the term "1,000 ml/liter of nitric acid" means that a total amount is made up of nitric acid.

If an oxidizing agent is used, the amount of the oxidizing agent in the dissolution solution is generally not smaller than 50 g/liter, preferably not smaller than 75 g/liter and the upper limit is generally not larger than 500 g/liter, preferably not larger than 300 g/liter. A smaller amount may lead to the possibility that the oxidizing force is so low that the reaction does not stop. On the other hand, a larger amount may lead to poor economy. The concentration of an acid, such as hydrochloric acid, sulfuric acid or the like, used together with an oxidizing agent is generally not smaller than 10 g/liter, preferably not smaller than 15 g/liter and the upper limit is generally not larger than 500/liter, preferably not larger than 300 g/liter. A smaller acid concentration may lead to the possibility that a substituted metal layer is unlikely to be dissolved. On the other hand, a larger concentration may result in concern for corrosion of members other than the aluminum or aluminum alloy. It is to be noted that the acid used herein is preferably a non-oxidative one although an oxidative acid such as nitric acid may also be used or an oxidative acid and a non-oxidative acid may be used in admixture. On the other hand, an alkaline cleaning solution used may be a known alkali etchant.

In such a dissolution treatment, a treating time is not critical and the dissolution treatment can be carried out, for example, over 5 to 30 seconds. For the dissolution treatment temperature, conditions, for example, of 10 to 40° C. can be adopted. During the dissolution treatment, a workpiece to be treated may be stood still or swung, and liquid agitation may be effected.

The step (D) is a step wherein zinc substitution treatment is again performed on the aluminum or aluminum alloy surface from which the substituted zinc film and the substituted metal layer have been removed in the step (C). In the practice of the invention, it is necessary from the standpoint of improving adhesion with a plated layer that a substituted zinc film be again formed on the aluminum or aluminum alloy surface by zinc substitution treatment. The zinc substitution treatment in the step (D) can make use of a treating solution as used in the zinc substitution treatment of the step (B) and similar treating conditions can also be used. In this step (D), a substituted zinc film is formed on the aluminum or aluminum alloy surface from which the substituted metal layer formed in the step (A) and the substituted zinc film formed in the step (B) have been removed, respectively.

When a plated layer is formed on the aluminum or aluminum alloy surface on which a substituted zinc film has been formed after the removal of the once formed substituted metal layer along with the once formed substituted zinc film, better adhesion between the aluminum or aluminum alloy surface and the plated layer than conventionally experienced can be achieved.

Although the reason for this is not known and no limitation is placed, according to the invention, on such a mechanism as described below, better adhesion is considered to develop in a manner as follows. If the substituted metal layer is removed by use of a liquid having an oxidizing behavior and used in the step (C) under conditions where the metal precipitated on the aluminum or aluminum alloy surface by substitution is present, exposed surfaces (of the aluminum or aluminum alloy), not covered with the substituted metal, are intensely oxidized by the influence of a difference in potential from the substituted metal, with the result that a thickness distribution on the aluminum or aluminum alloy surface develops wherein the thickness of the oxide film spottedly distributes. Although the oxide film at thin portions can be removed according to a subsequent zincate treatment, the oxide film at thick portions (an oxide region) is left without removal by the zincate treatment. If a plated layer is formed in this condition, adhesion between the aluminum or aluminum alloy surface and the plated layer is considered to become poor.

In contrast, according to the invention, portions not covered with the substituted film are immersed directly in a zincate treating solution prior to immersion in a liquid having an oxidizing behavior to cover the portions with a substituted zinc film, thereby preventing the aluminum metal activated by etching from exposure. In this connection, zinc may also be precipitated depending on the type of substituted metal when taking into account the relation to the ionization tendency. In this case, as viewed from the surface side, the entire surface is in a state covered with zinc metal as a result of the zinc substitution. Thereafter, in the step (C), the substituted metal layer is removed along with the substituted zinc film by use of a liquid having an oxidizing behavior, and thus the substituted metal layer can be removed by dissolution in such a way that the exposed surface of the aluminum or aluminum alloy does not suffer a direct influence of the difference in potential with the substituted metal layer. Hence, a uniform thin oxide film can be formed. This thin oxide film is removed by the zincate treatment in the step (D), under which when a plated layer is formed thereon, better adhesion is ensured.

In the present invention, after the step (D), the thus formed substituted zinc film may be removed, followed by further repeating formation treatment of a substituted zinc film. More particularly, the surface treatment method of aluminum or an aluminum alloy according to the invention may further include, if necessary, the steps (E) and (F) after the step (D):

(E) the step of removing the substituted zinc film by means of a liquid having an oxidizing behavior; and (F) the step of forming a substituted zinc film by zinc substitution treatment. The steps (E) and (F) may be carried out only once in this order or may be alternately carried out each twice or more.

In the case, the treatment of the step (E) can make use of such a liquid as used in the step (C) and similar treating conditions can also be used. In the step (E), the substituted zinc film formed in the step (D) or in the step (F) in a preceding cycle of the step (F).

The zinc substitution treatment in the step (F) can make use of such a treating solution as in the zinc substitution treatment in the step (B) and similar treating conditions can also be used. In the step (F), a substituted zinc film is formed on the aluminum or aluminum alloy surface after removal, in the step (E), of the substituted zinc film that has been formed in the step (D) or in the step (F) in a preceding cycle of the step (F).

In the practice of the invention, when a plated layer is formed on the substituted zinc film formed after the step (D) or (F), adhesion between the aluminum or aluminum alloy surface and the plated layer becomes better than conventionally experienced.

The plating method of forming a plated layer is not critical and either electroplating or electroless plating may be used.

The electroless plating method is lower in energy that an electroplating method and a pre-treatment therefor is especially important so as to form a plated layer without failure. According to the invention, a plated layer may be formed according to the electroless plating method while ensuring good adhesion since an impurity such as an aluminum oxide film or the like is completely removed.

It will be noted that when using an electroplating method, wiring is necessary, for which it may take a lot of labor for assembling an apparatus, a plating density may not be raised, or noises develop and thus, a difficulty may be involved in formation of a uniform plated layer. These problems can be solved using an electroless plating method.

The types of metals to be plated may be appropriately selected depending on the purpose in end use and usually include Cu, Ni, Au and the like. These may be formed as two or more layers. Plating baths and plating conditions may be those known in the art.

EXAMPLES

Examples and Comparative Examples are shown to more particularly illustrate the invention. The invention should not be construed as limited to examples described later.

Examples 1 to 3 and Comparative Examples 1 to 3

A silicon plate covered with a 5 μm thick aluminum layer by a sputtering method was provided as a workpiece to be plated and immersed in each of removing solutions, prepared as having formulations shown in Table 1, at 70° C. for 10 minutes. It will be noted that the pH values of the removing solutions were all set at one or below. Thereafter, according to zincate treatments (double treatments) shown in Table 2, the zincate treatments and removing treatments of a substituted metal layer and a substituted zinc film were carried out. Subsequently, a 1.0 μm thick nickel layer was plated according to an electroless plating method.

The resulting plated workpieces were evaluated with respect to adhesion thereof. As a sample, 25 pieces were cut out from the respective workpieces and subjected to measurement of adhesion according to the m-ELT method (modified-edge lift off test: see "Kobelnics" Vol. 13, pp. 6 to 8, October 2004, published by Kobelco Research Institute, Inc., and "Evaluation of Adhesion; m-ELT method," technical data of Toshiba Nanoanalysis Corporation). The results are also shown in Table 1. In all the cases, delamination between Ni and Al was observed. The numerical values of adhesion are indicated as an average value, respectively.

TABLE 1

| Concentration of formulated ingredients in 1 liter of water | | | Example/ Comparative Example 1 | 2 | 3 |
|---|---|---|---|---|---|
| Removing solution | Sulfuric acid (g/liter) | | 50 | 50 | 50 |
| | Metal salt (metal concentration · g/liter) | $AgNO_3$ | 0.5 | | |
| | | $NiSO_4 \cdot 6H_2O$ | | 0.5 | |
| | | $CuSO_4 \cdot 5H_2O$ | | | 0.5 |
| m-ELT (MPa · √m) | | Example | 0.30 | 0.32 | 0.31 |
| | | Comparative Example | 0.23 | 0.24 | 0.22 |

TABLE 2

| [Double zincate] | Example | | Comparative Example |
|---|---|---|---|
| Immersion in nitric acid *1 | No | | 21° C., 30 seconds |
| Zincate treatment *2 | 21° C., 10 seconds | Step (B) | 21° C., 10 seconds |
| Immersion in nitric acid *1 | 21° C., 60 seconds | Step (C) | 21° C., 60 seconds |
| Zincate treatment *2 | 21° C., 35 seconds | Step (D) | 21° C., 35 seconds |
| Electroless Ni plating *3 | 80° C., 300 seconds | | 80° C., 300 seconds |

*1 Nitric acid aqueous solution having a concentration of 500 ml/liter of water
*2 MCT-17, made by C. Uemura & Co., Ltd.
*3 NPR-18, made by C. Uemura & Co., Ltd.

Examples 4 to 6 and Comparative Examples 4 to 6

A silicon plate covered with a 5 μm thick Al—Si layer (with a Si content of 0.5 wt %) by a sputtering method was provided as a workpiece to be plated and immersed in each of removing solutions, prepared as having formulations shown in Table 3, at 70° C. for 10 minutes. It will be noted that the pH values of the removing solutions were all set at one or below. Thereafter, according to zincate treatments (triple treatments) shown in Table 4, the zincate treatments and removing treatments of a substituted metal layer and a substituted zinc film were carried out. Subsequently, a 1.0 μm thick nickel layer was plated according to an electroless plating method.

The resulting plated workpieces were evaluated with respect to adhesion thereof. As a sample, 25 pieces were cut out from the respective workpieces and subjected to measurement of adhesion according to the m-ELT method. The results are also shown in Table 3. In all the cases, delamination between Ni and Al was observed. The numerical values of adhesion are indicated as an average value, respectively.

TABLE 3

| Concentration of formulated ingredients in 1 liter of water | | | Example/ Comparative Example 4 | 5 | 6 |
|---|---|---|---|---|---|
| Removing solution | Sulfuric acid (g/liter) | | 50 | 50 | 50 |
| | Phosphoric acid (g/liter) | | 70 | 70 | 70 |
| | PEG-1000 (g/liter) | | 1 | 1 | 1 |
| | Metal salt (metal concentration · g/liter) | $AgNO_3$ | 0.5 | | 0.1 |
| | | $NiSO_4 \cdot 6H_2O$ | | 0.5 | |
| | | $CuSO_4 \cdot 5H_2O$ | | 0.05 | 0.5 |
| m-ELT (MPa · √m) | | Example | 0.30 | 0.31 | 0.30 |
| | | Comparative Example | 0.24 | 0.23 | 0.26 |

PEG: polyethylene glycol

TABLE 4

| [Triple zincate] | Example | | Comparative Example |
|---|---|---|---|
| Immersion in nitric acid *1 | No | | 21° C., 30 seconds |
| Zincate treatment *2 | 21° C., 10 seconds | Step (B) | 21° C., 10 seconds |
| Immersion in nitric acid *1 | 21° C., 30 seconds | Step (C) | 21° C., 30 seconds |
| Zincate treatment *2 | 21° C., 10 seconds | Step (D) | 21° C., 10 seconds |
| Immersion in nitric acid *1 | 21° C., 60 seconds | Step (E) | 21° C., 60 seconds |
| Zincate treatment *2 | 21° C., 35 seconds | Step (F) | 21° C., 35 seconds |
| Electroless Ni plating *3 | 80° C., 300 seconds | | 80° C., 300 seconds |

*1 Nitric acid aqueous solution having a concentration of 500 ml/liter of water
*2 MCT-17, made by C. Uemura & Co., Ltd.
*3 NPR-18, made by C. Uemura & Co., Ltd.

Examples 7 to 9 and Comparative Examples 7 to 9

A silicon plate covered with a 5 μm thick aluminum layer by a sputtering method was provided as a workpiece to be plated and immersed in each of removing solutions, prepared as having formulations shown in Table 5, at 50° C. for 60 seconds. It will be noted that the pH values of the removing solutions were all set at 12.4. Thereafter, according to zincate treatments (double treatments) shown in Table 2, the zincate treatments and removing treatments of a substituted metal layer and a substituted zinc film were carried out. Subsequently, a 1.0 μm thick nickel layer was plated according to an electroless plating method.

The resulting plated workpieces were evaluated with respect to adhesion thereof. As a sample, 25 pieces were cut out from the respective workpieces and subjected to measurement of adhesion according to the m-ELT method. The results are also shown in Table 5. In all the cases, delamination between Ni and Al was observed. The numerical values of adhesion are indicated as an average value, respectively.

TABLE 5

| Concentration of formulated ingredients in 1 liter of water | | | Example/ Comparative Example 7 | 8 | 9 |
|---|---|---|---|---|---|
| Removing solution | Alkali (base) | TMAH | Amount sufficient to adjust the pH to a value indicated below | | |
| | Solubilizer | EDTA•2Na (g/liter) | 10 | 10 | 10 |
| | Metal salt (metal concentration · g/liter) | $MnSO_4 \cdot 5H_2O$ | 1 | | |
| | | $ZnSO_4 \cdot 7H_2O$ | | 2 | |
| | | $CuSO_4 \cdot 5H_2O$ | | | 0.05 |
| | pH | | 12.4 | 12.4 | 12.4 |
| m-ELT (MPa · √m) | | Example | 0.32 | 0.34 | 0.30 |
| | | Comparative Example | 0.25 | 0.27 | 0.24 |

Examples 10 to 12 and Comparative Example 10 to 12

A silicon plate covered with a 5 μm thick Al—Si layer (with a Si content of 0.5 wt %) by a sputtering method was provided as a workpiece to be plated and immersed in each of removing solutions, prepared as having formulations shown in Table 6, at 50° C. for 60 seconds. It will be noted that the pH values of the removing solutions were all set at 12.4. Thereafter, according to zincate treatments (triple treatments) shown in Table 4, the zincate treatments and removing treatments of a substituted metal layer and a substituted zinc film were carried out. Subsequently, a 1.0 μm thick nickel layer was plated according to an electroless plating method.

The resulting plated workpieces were evaluated with respect to adhesion thereof. As a sample, 25 pieces were cut out from the respective workpieces and subjected to measurement of adhesion according to the m-ELT method. The results are also shown in Table 6. In all the cases, delamination between Ni and Al was observed. The numerical values of adhesion are indicated as an average value, respectively.

TABLE 6

| Concentration of formulated ingredients in 1 liter of water | | | Example/ Comparative Example 10 | 11 | 12 |
|---|---|---|---|---|---|
| Removing solution | Alkali (base) | NaOH | Amount sufficient to adjust the pH to a value indicated below | | |
| | Solubilizer | EDTA•2Na (g/liter) | 10 | 10 | 10 |
| | Surface active agent | PEG-1000 (g/liter) | 1 | 1 | 1 |

TABLE 6-continued

| Concentration of formulated ingredients in 1 liter of water | | Example/ Comparative Example 10 | 11 | 12 |
|---|---|---|---|---|
| Metal salt (metal concentration · g/liter) | $MnSO_4 \cdot 5H_2O$ | 1 | | |
| | $ZnSO_4 \cdot 7H_2O$ | | 2 | |
| | $CuSO_4 \cdot 5H_2O$ | | | 0.05 |
| pH | | 12.4 | 12.4 | 12.4 |
| m-ELT (MPa · √m) | Example | 0.33 | 0.31 | 0.34 |
| | Comparative Example | 0.24 | 0.25 | 0.27 |

PEG: polyethylene glycol

The invention claimed is:

1. A method of surface treatment for aluminum or aluminum alloy, comprising the steps of:

(A) immersing a workpiece to be treated, which comprises aluminum or an aluminum alloy on at least a surface thereof, in an alkaline aluminum oxide film-removing solution comprising a salt or oxide of a metal capable of substitution with aluminum and a solubilizer for ions of said metal, and forming a substituted metal layer of said metal, which is capable of substitution with aluminum and is contained in said removing solution, on a surface of the aluminum or aluminum alloy while removing an aluminum oxide film on said aluminum or aluminum alloy surface;

(B) forming a substituted zinc film by zinc substitution treatment without removal of said substituted metal layer;

(C) removing said substituted metal layer along with said substituted zinc film by means of a liquid having an oxidizing behavior; and (D) subjecting the resulting surface to zinc substitution treatment again to form a substituted zinc film thereon, wherein said metal is selected from the group consisting of manganese, iron, cobalt, nickel, tin, lead, copper, mercury, silver, platinum, gold and palladium.

2. The surface treatment method according to claim 1, wherein a plated layer is formed on said substituted zinc film after the step (D).

3. The surface treatment method according to claim 1, further comprising, after the step (D), the steps of:

(E) removing said substituted zinc film by means of a liquid having an oxidizing behavior; and (F) further subjecting the resulting surface to zinc substitution treatment to form a substituted zinc film thereon, the steps (E) and (F) being carried out only once in this order, or being alternately repeated twice or more.

4. The surface treatment method according to claim 1, wherein in the step (B), said substituted zinc film is formed on said substituted metal layer.

5. The surface treatment method according to claim 1, wherein an amount of said metal in said aluminum oxide film-removing solution is not less than 1 mg/liter and not more than 10,000 mg/liter.

6. The surface treatment method according to claim 1, wherein said aluminum oxide film-removing solution comprises polyethylene glycol and/or a surface active agent.

7. The surface treatment method according to claim 1, wherein said zinc substitution treatment is an alkaline zincate treatment.

8. The surface treatment method according to claim 1, wherein said aluminum oxide film-removing solution has a pH of from 10 to 13.5.

9. The surface treatment method according to claim 1, wherein said aluminum oxide film-removing solution contains tetramethylammonium hydroxide or choline as an alkali.

10. The surface treatment method according to claim 3, wherein a plated layer is formed on said substituted zinc film after the step (F).

11. The surface treatment method according to claim 3, wherein said zinc substitution treatment in step (D) is an alkaline zincate treatment.

12. The surface treatment method according to claim 3, wherein said metal is selected from the group consisting of nickel, copper and silver.

13. The surface treatment method according to claim 3, wherein said metal is selected from the group consisting of manganese, and copper.

* * * * *